US011024985B2

(12) United States Patent
Fleming et al.

(10) Patent No.: US 11,024,985 B2
(45) Date of Patent: Jun. 1, 2021

(54) INSULATED EXTERNAL PARKING BUSHING

(71) Applicants: Shad Patrick Fleming, San Diego, CA (US); Anthony Christopher Simmons, El Cajon, CA (US)

(72) Inventors: Shad Patrick Fleming, San Diego, CA (US); Anthony Christopher Simmons, El Cajon, CA (US)

( * ) Notice: Subject to any disclaimer, the term of this patent is extended or adjusted under 35 U.S.C. 154(b) by 0 days.

(21) Appl. No.: 16/784,187

(22) Filed: Feb. 6, 2020

(65) Prior Publication Data

US 2020/0176896 A1 Jun. 4, 2020

Related U.S. Application Data

(63) Continuation-in-part of application No. 15/965,824, filed on Apr. 27, 2018, now abandoned.

(60) Provisional application No. 62/491,224, filed on Apr. 27, 2017.

(51) Int. Cl.
*H01R 13/53* (2006.01)
*H01R 4/26* (2006.01)
*H01R 4/28* (2006.01)

(52) U.S. Cl.
CPC ..... *H01R 4/26* (2013.01); *H01R 4/28* (2013.01); *H01R 13/53* (2013.01)

(58) Field of Classification Search
CPC ..... H01R 4/26; H01R 4/28; H01R 13/53
USPC ..... 439/134, 149, 150, 521, 718, 892, 901
See application file for complete search history.

(56) References Cited

U.S. PATENT DOCUMENTS 3,617,986 A * 11/1971 Becker ..... H01R 4/52 439/277
3,696,321 A * 10/1972 Cooper, Jr. ..... H01R 9/16 439/566
3,766,310 A * 10/1973 Paschen ..... H01R 13/516 174/138 F
3,980,374 A * 9/1976 Fallot ..... H01R 13/53 439/89
4,659,164 A * 4/1987 Reuss ..... H01R 24/38 439/607.41
4,677,255 A * 6/1987 Cumley ..... H02G 15/10 174/87
4,762,501 A * 8/1988 Borgstrom ..... H01R 13/53 439/131
4,955,823 A * 9/1990 Luzzi ..... H01R 13/53 439/507

(Continued)

*Primary Examiner* — Abdullah A Riyami
*Assistant Examiner* — Nelson R. Burgos-Guntin
(74) *Attorney, Agent, or Firm* — White-Welker & Welker, LLC; Matthew T. Welker, Esq.

(57) ABSTRACT

The Insulated External Parking Bushing provides a means of safely securing the loadbreak elbow connector by bypassing the damaged components and securing the loadbreak elbow connector from the outside of the elbow and covering the exposed conductive material, and then placed onto the equipment's parking stand. The Insulated External Parking Bushing is the addition of a supporting device to a standard loadbreak elbow connector which hugs the loadbreak elbow connector. The Insulated External Parking Bushing is crafted from injection molds in one solid piece from dielectrically rated plastics or rubber, with the parking bracket identical to existing insulated parking bushings, with variant molds adding skirts for higher voltages.

9 Claims, 13 Drawing Sheets

(56) References Cited

U.S. PATENT DOCUMENTS

| | | | | | |
|---|---|---|---|---|---|
| 5,082,449 | A * | 1/1992 | Borgstrom | H01R 13/53 | 439/190 |
| 5,088,001 | A * | 2/1992 | Yaworski | H01C 7/12 | 361/127 |
| 5,215,475 | A * | 6/1993 | Stevens | H01R 13/5227 | 439/190 |
| 6,332,785 | B1 * | 12/2001 | Muench, Jr. | H01R 13/53 | 439/88 |
| 6,790,063 | B2 * | 9/2004 | Jazowski | H01R 13/5205 | 439/181 |
| 6,843,685 | B1 * | 1/2005 | Borgstrom | H01R 13/53 | 439/606 |
| 7,503,785 | B2 * | 3/2009 | Stepniak | H01R 13/53 | 439/187 |
| 7,704,087 | B1 * | 4/2010 | Stagi | H02G 15/26 | 439/204 |
| 7,883,356 | B2 * | 2/2011 | Hughes | H01R 13/6335 | 439/445 |
| 7,985,093 | B2 * | 7/2011 | Luzzi | H01R 13/53 | 439/374 |
| 8,282,410 | B2 * | 10/2012 | Siebens | H01R 31/06 | 439/362 |

* cited by examiner

INSULATED EXTERNAL PARKING BUSHING

FEDERALLY SPONSORED RESEARCH

Not Applicable

SEQUENCE LISTING OR PROGRAM

Not Applicable

TECHNICAL FIELD OF THE INVENTION

The present invention relates generally to the electric power distribution industry. More specifically, the present invention relates to the use of polymeric cable and loadbreak elbows that enable switching and isolation to be carried out in the high voltage (HV) chamber in what is known as a "dead front" environment.

BACKGROUND OF THE INVENTION

Malfunctions frequently occur during de-energizing operations where the internal components of the device the elbow is being removed from are pulled out with the elbow and cannot be landed on a standard insulated parking bushing (IPB).

This circumstance requires that one employee remain stranded to hold the elbow and exposed energized components with live line tools (hot sticks) while other employees attempt to de-energize the cable upstream. Oftentimes, accessing the upstream feed can be a multi-personnel operation in itself, which may require the crew to wait for additional help to arrive.

The loadbreak elbow connectors (LECs) currently being used in the industry and in the prior art have a design flaw that creates a dangerous situation for a lineworker. This shortcoming is that the probe and arc follower must land inside the parking stand tube. In the case of a malfunction of the arc follower, the probe and the arc follower cannot fit inside the parking stand or device it was connected to originally. Similar to a key in a key hole, if something like a previously used key breaks off inside, you can't put another key in until the blockage is removed. In the case of a line work, this is not easily accomplished due to the electricity in the line.

Therefore what is needed is a means of safely securing the loadbreak elbow connector by bypassing the damaged components and securing the loadbreak elbow connector from the outside of the elbow and covering the exposed conductive material, and then placing it onto the equipment's parking stand.

Definitions

A hot stick is an insulated pole, usually made of fiberglass, used by electric utility workers when engaged in live-line work on energized high-voltage electric power lines, to protect them from electric shock. Depending on the tool attached to the end of the hot stick, it is possible to test for voltage, tighten nuts and bolts, apply tie wires (twisted lengths of ductile wire which fasten the running cable to its supporting insulators), open and close switches, replace fuses, lay insulating sleeves on wires, and perform various other tasks while not exposing the crew to a large risk of electric shock.

A loadbreak elbow connector (LEC) is a fully shielded and insulated plug-in separable connector for connecting 5 to 25 kV underground cable to transformers, switchgear and junctions equipped with loadbreak bushings. The elbow and the bushing insert comprise the essential components of all loadbreak connections.

A loadbreak switch is an electric switch in a circuit with several thousand volts, designed to carry a large amount of current without overheating the closed position, having enough insulation to isolate the circuit in an open position, and equipped with arc interrupters to interrupt the load current.

A padmount or pad-mounted transformer is a ground mounted electric power distribution transformer in a locked steel cabinet mounted on a concrete pad. Since all energized connection points are securely enclosed in a grounded metal housing, a padmount transformer can be installed in places that do not have room for a fenced enclosure. Padmount transformers are used with underground electric power distribution lines at service drops, to step down the primary voltage on the line to the lower secondary voltage supplied to utility customers. A single transformer may serve one large building, or many homes.

SUMMARY OF THE INVENTION

The insulated external parking bushing of the present invention provides a means of safely securing the loadbreak elbow connector by bypassing the damaged components and securing the LEC from the outside of the elbow and covering the exposed conductive material, and then placed onto the equipment's parking stand.

The present invention is the addition of a supporting device to a standard loadbreak elbow connector which hugs the loadbreak elbow connector. The insulated external parking bushing is crafted from injection molds in one solid piece from dielectrically rated plastics or rubber, with the parking bracket identical to existing IPBs, with variant molds adding skirts for higher voltages.

BRIEF DESCRIPTION OF THE DRAWINGS

The accompanying drawings, which are incorporated herein a form a part of the specification, illustrate the present invention and, together with the description, further serve to explain the principles of the invention and to enable a person skilled in the pertinent art to make and use the invention.

DETAILED DESCRIPTION OF THE INVENTION

Figure 1A:
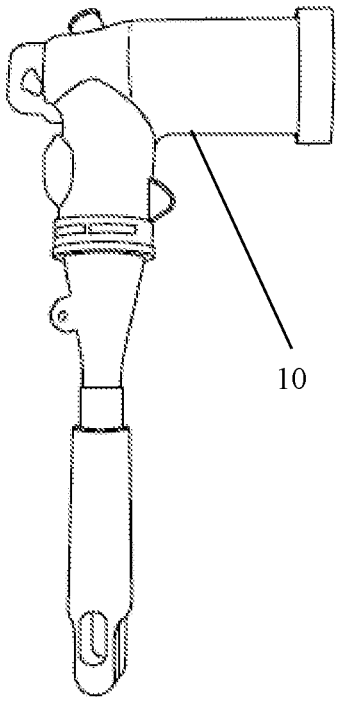
FIG. 1A PRIOR ART
FIGS. 1A and 1B illustrate the prior art of a standard loadbreak elbow known in the prior art and industry.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention.

Not all components are shown or illustrated in the drawings as they are well known in the art and not necessary for one of ordinary skill in the art to make or use the present invention. Drawings of these elements are necessary for the understanding of the subject matter to be patented. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

The present invention is an insulated external parking bushing. The insulated external parking bushing is comprised of: a body member; a contact head extending from the body member for receiving an end of a conductor probe; a receptor sleeve extending from the body member opposite the contact head; and a conductive sleeve, including a connector cup, for receiving an end of a power cable.

In use, an external parking bushing is attached to the body and the receptor sleeve; and the insulated external parking bushing removeably secured to an existing external parking bushing and receptor sleeve and body, covering the contact head and the conductor probe.

The body of the insulated external parking bushing may be made from a one piece injection mold or constructed from dielectrically rated plastics or rubber.

The body of the insulated parking bushing is identically molded to match the parking bracket. In an alternative embodiment, the body of the insulated parking bushing is molded to add skirts for higher voltages. In yet another embodiment, the body of the insulated parking bushing is further comprised of a cut out for easier coupling or attachment to a loadbreak elbow.

The insulated external parking bushing is used in combination with an electrical load break elbow connector having a conductive probe for making an electrical connection between a high voltage cable and a bushing on electrical power distribution equipment.

The insulating cover for a electrical loadbreak elbow connectors comprises a conductor element; wherein the conductor element comprises a connector socket, arranged at the first end portion, for mating with a cable plug, characterized by the connector socket being integrally formed with the middle portion, and an insulated external parking bushing removeably secured to the connector socket, covering the conductor element.

The conductor element further comprised of: a first end portion, a second end portion, and a middle portion disposed between the first end portion and the second end portion.

A method of protecting a loadbreak elbow connector during a malfunction includes the following steps: providing one or more loadbreak elbow connectors; connecting the loadbreak elbow connector to a bushing plug of a transformer; removing the loadbreak elbow connector from a bushing plug; pulling out the conductive components from the transformer with the loadbreak elbow connector; and securing an insulated external parking bushing to the connector loadbreak elbow connector, covering the conductive components.

Figure 1B:
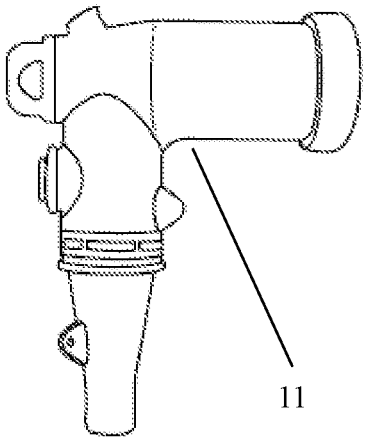
FIG. 1B PRIOR ART

The purpose of the external insulated parking bushing (EIPB) is to provide lineworkers operating different loadbreak elbow connectors 10 and 11 that are well known in the art, as shown in FIGS. 1A and 1B, an added level of protection in the event of a malfunction. Malfunctions frequently occur during de-energizing operations where the internal components of a device 200 when the elbow 201 is being removed from are pulled out with the elbow 201 and cannot be landed on a standard insulated parking bushing 300, IPB, as shown in FIG. 3 or the device of the present invention 202 as shown in FIGS. 2 and 5.

Figure 2B:
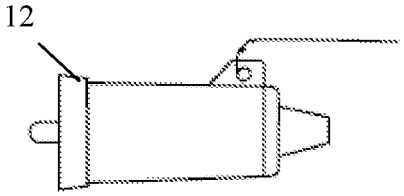
FIG. 2B illustrates an example of the probe and arc snuffer breaking inside the device.
Figure 2A:
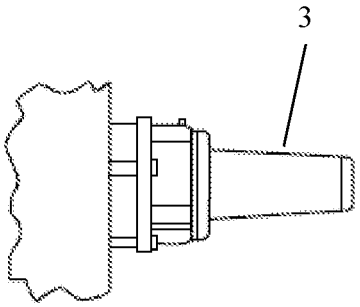
FIG. 2A illustrates where an elbow is landed on the equipment.
Figure 2C:
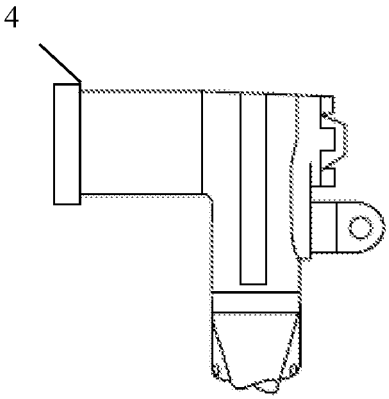
FIG. 2C illustrates a first situation where the internal components of the device where the elbow is being removed from are pulled out with the elbow and cannot be landed on the device.

FIG. 2A illustrates where an elbow is landed on the equipment. FIG. 2B illustrates an example of the probe and arc snuffer breaking inside the device. FIG. 2C illustrates a first situation where the internal components of the device 3 where the elbow connector 4 is being removed from are pulled out with the elbow and cannot be landed on the device. In this situation an insulated cap 12 is desired to cover the device 3 when the elbow connector 4 is removed.

Figure 3A:
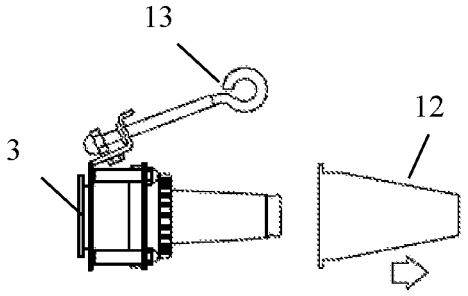
FIG. 3A illustrates a landing bushing as taught by the present invention.
Figure 3B:
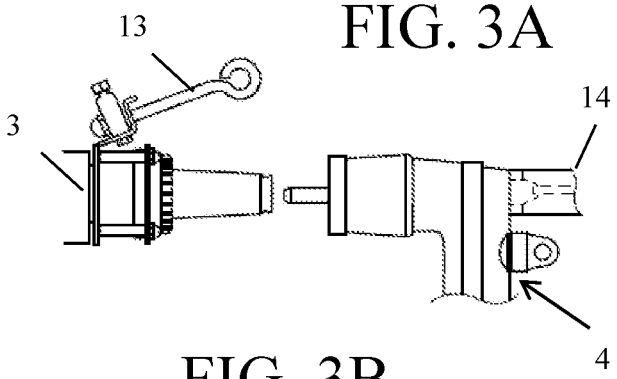
FIG. 3B illustrates the normal operation of landing an elbow connector onto the landing bushing as taught by the present invention.

FIG. 3A illustrates a landing bushing as taught by the present invention. In FIG. 3A, an eyebolt 13 is typically part of the device 3. A protective cap is removed to expose the device's internals and an elbow connector 4 is attempted to be connected to the device 3. FIG. 3B illustrates the normal operation of landing an elbow connector onto the landing bushing as taught by the present invention.

This circumstance requires that one employee remain stranded to hold the elbow 4 and exposed energized components with live line tools (hot sticks) 14 while other employees attempt to de-energize the cable upstream. Oftentimes, accessing the upstream feed can be a multi-personnel operation in itself, which may require the crew to wait for additional help to arrive.

Figure 6:
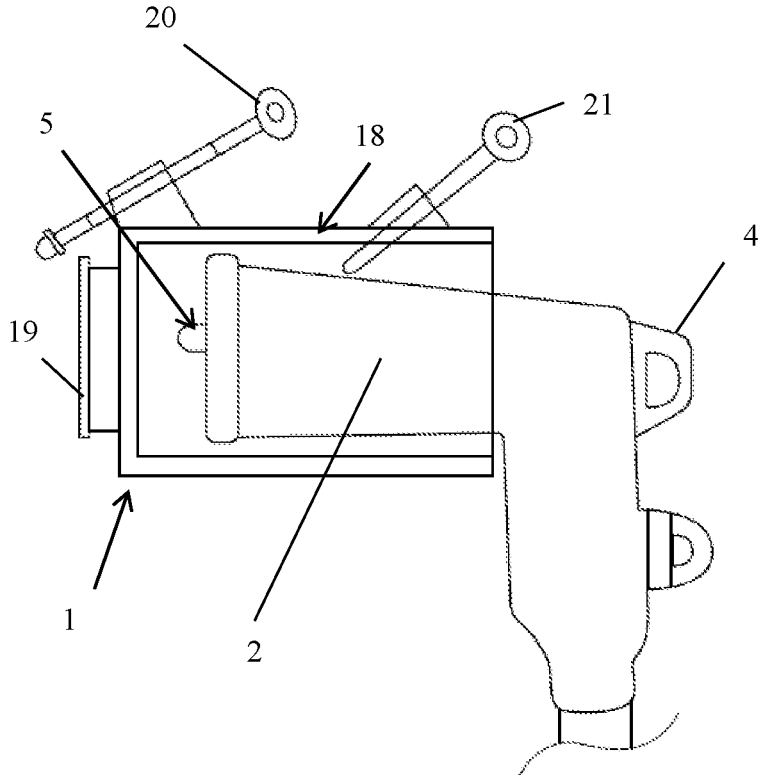
FIG. 6 illustrates the insulated external parking bushing of the present invention's component parts and how they interact when in use with other existing components on a structure.

The insulated external parking bushing 1 of the present invention provides a means of safely securing the LEC by bypassing the damaged components and securing the loadbreak elbow connector 4 from the outside of the elbow and covering the exposed conductive material, and then placed onto the equipment's parking stand as shown in FIG. 6. The insulated external parking bushing 1 is crafted from injection molds in one solid piece from dielectrically rated plastics or rubber, with the parking bracket 19 identical to existing IPBs, with variant molds adding skirts 18 for higher voltages.

Figure 4A:
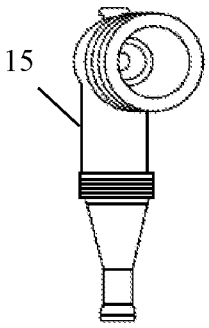
FIG. 4A PRIOR ART
FIGS. 4A, 4B, and 4C illustrate a standard, prior art, loadbreak elbow connectors, their manner of use, and internal components that are well known in the art.
Figure 4B:
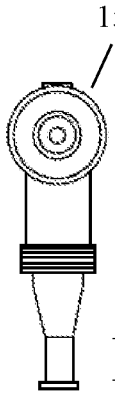
FIG. 4B PRIOR ART
Figure 4C:
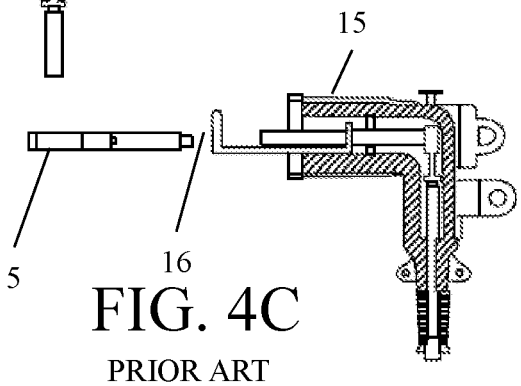
FIG. 4C PRIOR ART

FIGS. 4A, 4B, and 4C illustrate a standard, prior art, loadbreak elbow connectors 15, their manner of use, and internal components, which are well known in the art and are not required to be disclosed or discussed in detail for a person of ordinary skill in the art to understand a standard loadbreak connector 15 and its corresponding internal components. The loadbreak elbow connectors 15 are generally comprised of a twist and push connection fitting and center alignment. The probe 5 provides the center alignment and a wrench hole 16 provides for securing the probe to the elbow connector 4 and creating the conductive portion 6.

Figure 8:
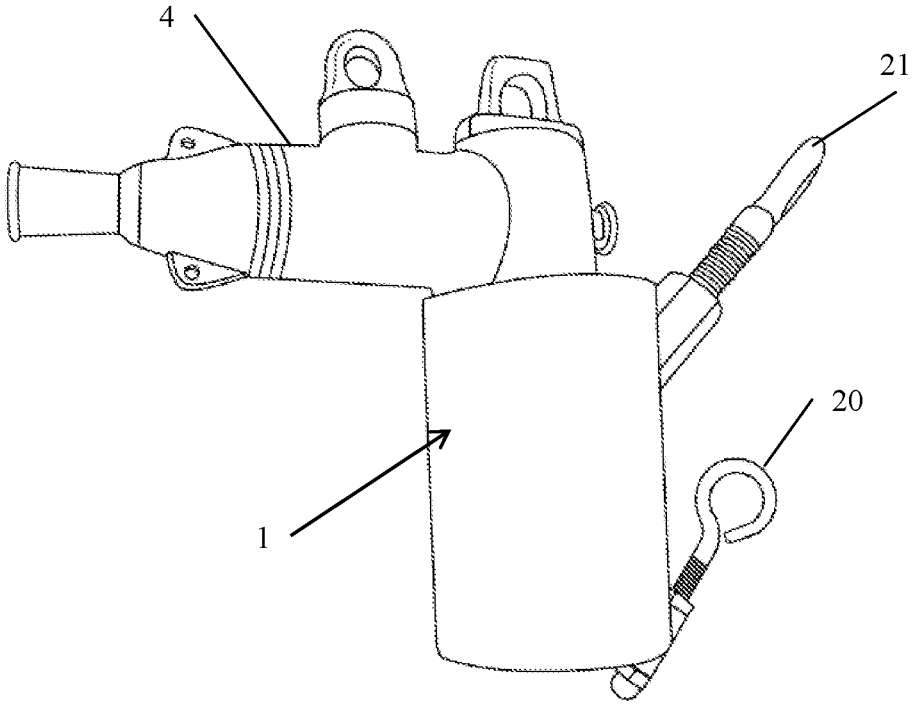
FIG. 8 is a side image of a prototype of the present invention in development.

The present invention is an insulated external parking bushing 1 as shown in FIG. 8 which is constructed out of PPC pipe. The insulated external parking bushing 1 in FIGS. 6 and 8 which 'hugs' the loadbreak elbow connector 4. The present invention does not include the loadbreak elbow connector 4, but it must be used in combination with a loadbreak elbow connector 4.

Figure 7:
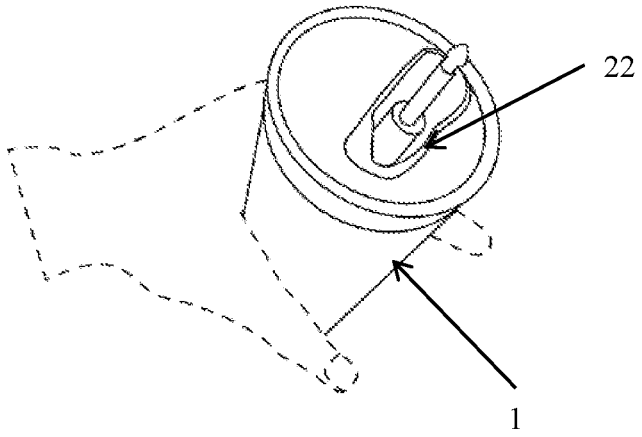
FIG. 7 illustrates the frontal cone of a connector elbow with the damage components illustrated.

FIG. 7 illustrates the frontal cone of a connector elbow with the damage components illustrated. FIG. 7 illustrates a common situation where an elbow connector 4 has a damaged probe 22 and needs to be covered and isolated for worker safety.

Figure 5A:
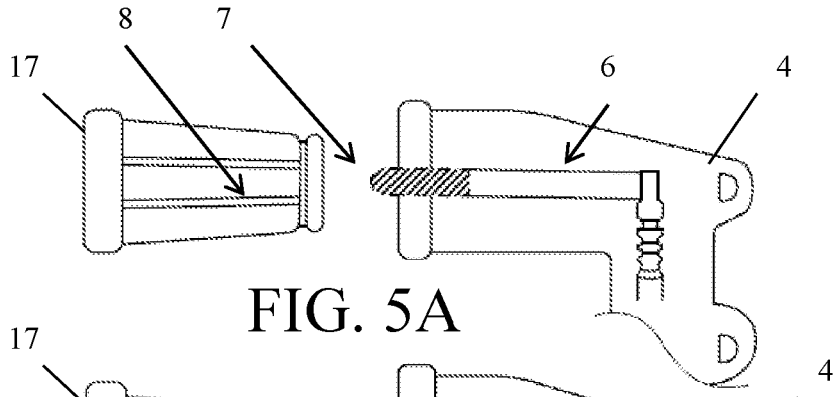
FIGS. 5A and 5B illustrates a second situation where the internal components of the device where the elbow is being removed from are pulled out with the elbow and cannot be landed on the device.
Figure 5B:
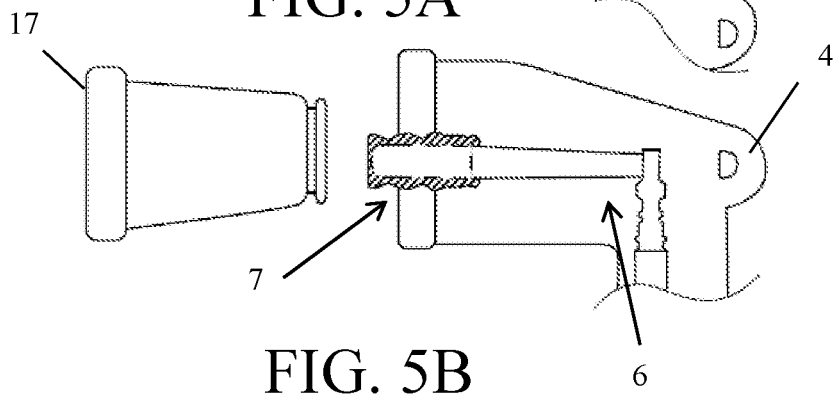

Now referring to FIG. 5, the conductive portion within the elbow connector 4 is defined as a probe 5. The probe 5 consists of a conductive portion 6 and the arc follower 7. The arc follower 7 is designed to extinguish an arc when de-energizing equipment under load. FIG. 5A shows the elbow connector 4 and probe 5 under a normal operation. FIG. 5B illustrates what occurs under a malfunction, where, the voltage is not conducted properly.

A common malfunction is a swollen arc follower 7 which occurs when moisture has been allowed to migrate in between the elbow body 2 and the device 3 it is connected to resulting in heat that causes the arc follower 7 to swell and impinge on the conductor contact assembly 8 of the device 3 bushing plug 17 to which it is attached.

FIG. 6 illustrates the insulated external parking bushing 1 of the present invention's component parts and how they interact when in use with other existing components on a structure. The insulated external parking bushing 1 is crafted from injection molds in one solid piece from dielectrically rated plastics or rubber, with the parking bracket 19 identical to existing IPBs, with variant molds adding skirts 18 for higher voltages. A first steel securing bolt can be used to secure the insulated external parking bushing 1 to a structure or provide a connection point to a hotstick 14. A second bolt 21 is used to secure a loadbreak elbow 4 and retain it securely within the insulated external parking bushing 1. Each bolt is comprised of a live line ring or eye bolt that can be engaged by a hotstick 14 or other device to turn the bolts 20 and 21 to tighten or loosen them as desired.

When using the present invention, one employee would land the device with a hotstick and a second employee would land the damaged elbow in the device. The insulated external parking bushing 1 of the present invention works with all current hot sticks 14 known in the prior art and currently used in the industry. The insulated external parking bushing 1 of the present invention will require two people to operate but the advantage over standard prior art devices is that the then allows one or both of them to leave the site with the damaged elbow secured. Currently one employee would be required to remain with the energized conductor held in the clear (safe) until additional help arrives.

In a real world situation, typically two linemen are dispatched to de-energize a pad mounted three phase transformer so that a business being fed by it can upgrade its electrical panel. The transformer has no on-off switch and is de-energized by pulling off its high voltage feed cables using loadbreak elbow connectors with the approved live line tool (hot stick). The employees arrive on scene and obtain the appropriate authorization to operate the three loadbreak elbow connectors feeding the transformer from the control center.

What follows are three scenarios possible with scenario A representing a normal operation with no malfunction; scenario B representing what occurs when the elbow connector malfunctions due to a swollen arc follower in the current paradigm; scenario C representing what occurs with a similar malfunction when the external insulated parking bushing of the present invention is used.

In Scenario A, lineman 1 opens the transformer and installs three insulated parking bushings on the transformer's parking stands. One at a time, lineman 1 unplugs each of the three loadbreak elbows and lands them on their respective insulated parking bushing while lineman 2 acts a safety observer. The business completes its upgrade and the linemen once again receive authorization to operate the three loadbreak elbows from the control center. One at a time, lineman 1 removes then elbow connectors from their parking bushings and plugs them into the transformer, restoring service.

In Scenario B: lineman 1 opens the transformer and installs three insulated parking bushings on the transformer's parking stands. One at a time, lineman 1 begins to unplug the three loadbreak elbows. Upon unplugging the second elbow connector, both linemen realize that the probe inside the elbow has pulled out the conductive components from the transformer it was connected to.

The elbow is now incapable of being landed on either the transformer or the insulated parking bushing. Lineman 2 retrieves another hotstick from the truck and unplugs the last elbow connector and lands it on its parking bushing while lineman 1 attempts to hold the damaged energized elbow connector clear of any second points of contact. The electricians working on the panel are instructed to stay clear of the panel in the event lineman 1 should lose control of the elbow and it make contact with the case of the transformer which is connected to the panel via its neutral. Lineman 1 barricades the area around the transformer as best he can to prevent possible public interaction with the situation. Lineman 1 is still holding the damaged elbow in the clear. Lineman 2 contacts the control center to inform them of the situation.

They review the circuit maps and find that the transformer is being fed from a handhole 300 ft away. Opening the handhole and de-energizing the cable there is a two person operation. Dispatch is contacted and addition help is requested. An estimated 1-2 hours later, an on duty lineman arrives to assist in the de-energizing at the handhole. The cable is de-energized successfully and the crew can go about repairing the damaged connector at the transformer. Lineman 1 has been holding the energized conductor the entire time.

In Scenario C: lineman 1 opens the transformer and installs three insulated parking bushings on the transformer's parking stands. One at a time, lineman 1 begins to unplug the three loadbreak elbows. Upon unplugging the second elbow connector, both linemen realize that the probe inside the elbow has pulled out the conductive components from the transformer it was connected to. The elbow is now incapable of being landed on either the transformer or the insulated parking bushing. Lineman 2 retrieves another hotstick and two external insulated parking bushings.

While lineman 1 holds the energized elbow clear, lineman 2 installs the two external insulated parking bushings in place of the standard ones. Lineman 1 lands the malfunctioning elbow in the external bushing and secures it. Just to be safe, when they unplug the remaining elbow, they land it also on an external insulated parking bushing as it may also malfunction.

With the transformer successfully de-energized and the elbows secured, the electricians can go about their work. Both linemen lock the transformer and call the control center. Without having to wait for additional help they follow similar procedures outlined in scenario B and make repairs to the elbow connectors and are ready to re-energize the transformer when the electricians complete their work.

Figure 9:
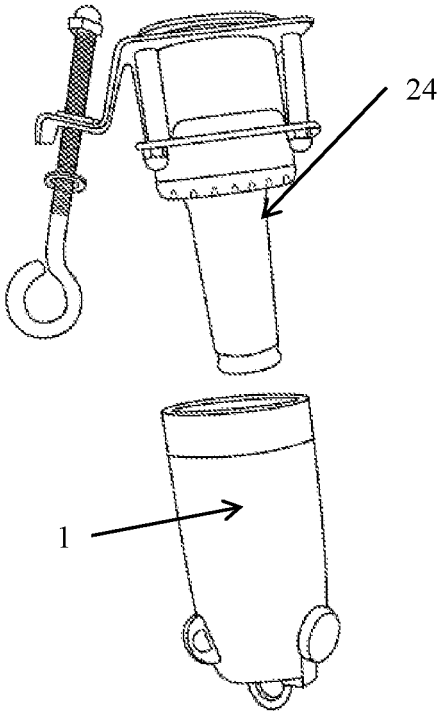
FIG. 9 PRIOR ART
FIGS. 9 and 10 are different perspective views of regular insulated parking bushings known in the prior art.
Figure 10:
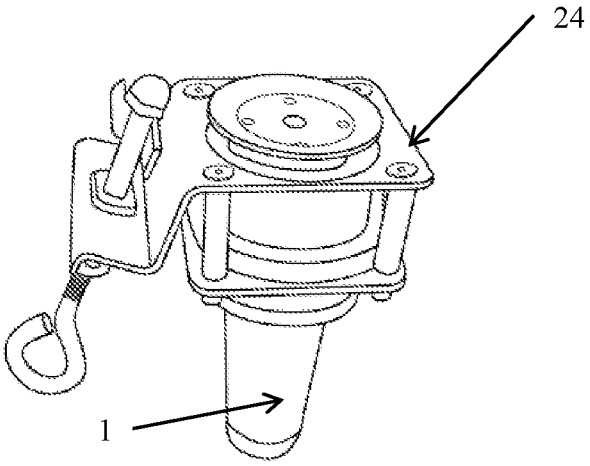
FIG. 10 PRIOR ART

FIGS. 9 and 10 are different perspective views of regular insulated parking bushings known in the prior art.

Figure 11:
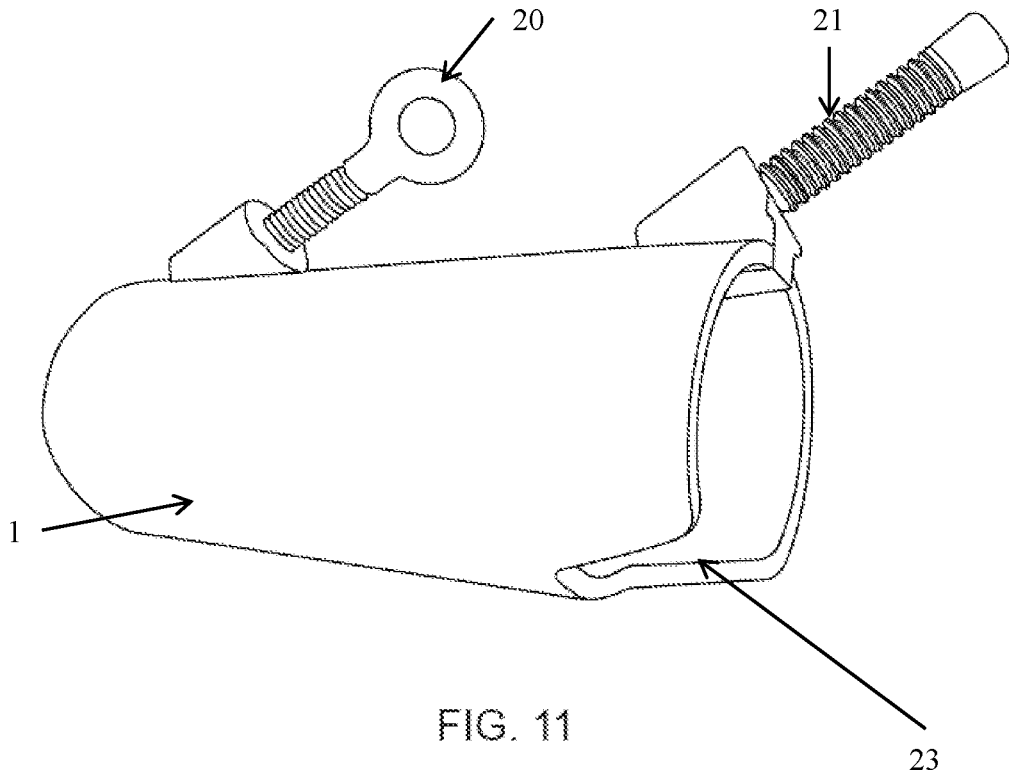
FIGS. 11, 12, and 13 are images of the insulated external parking bushing of the present invention, which also include and illustrate a potential cut out for easier coupling or attachment to standard loadbreak elbow known in the prior art and industry.
Figure 12:
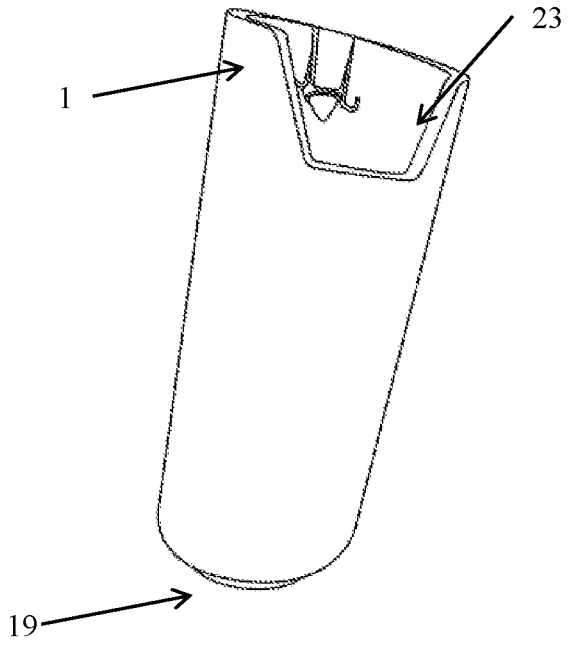
Figure 13:
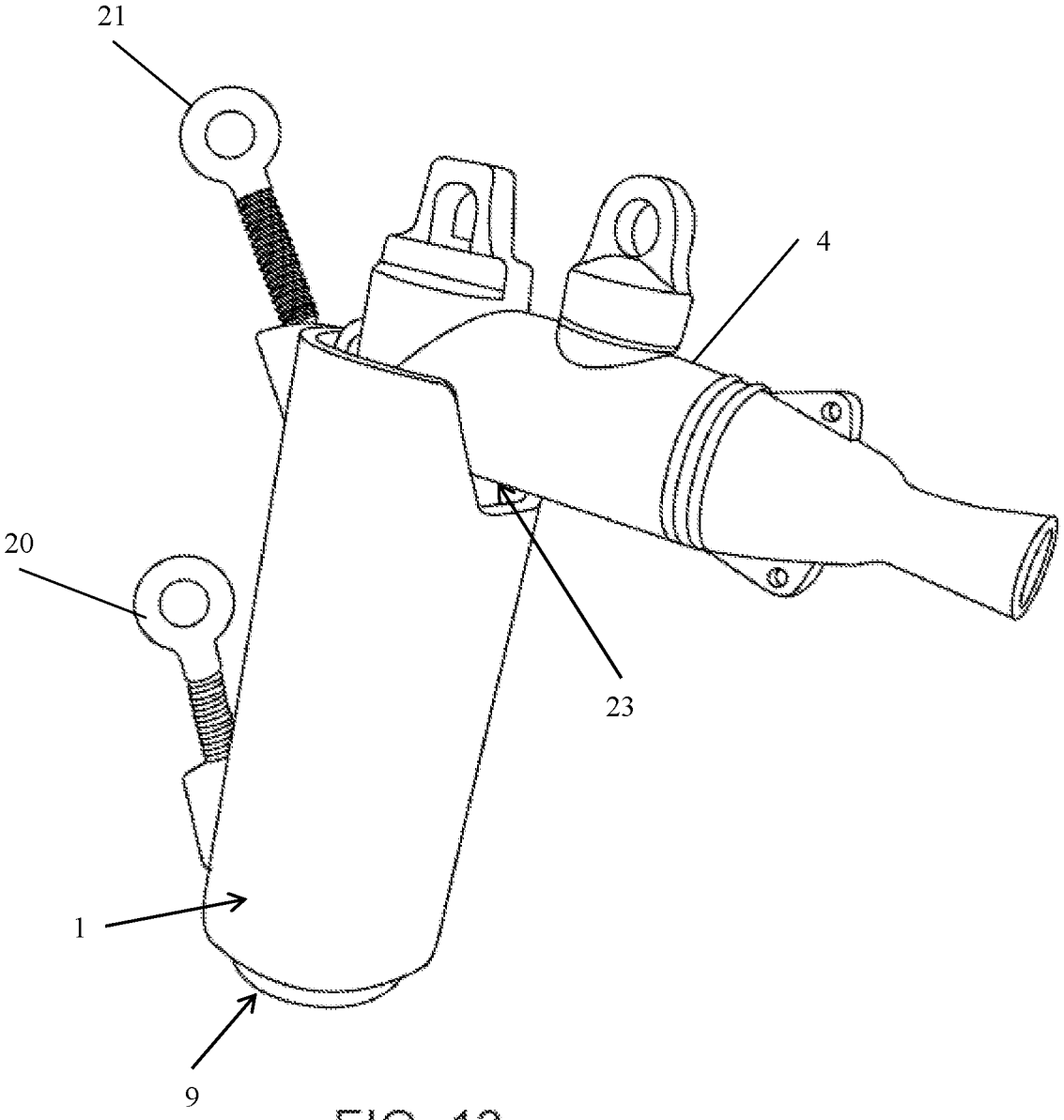
Figure 14:
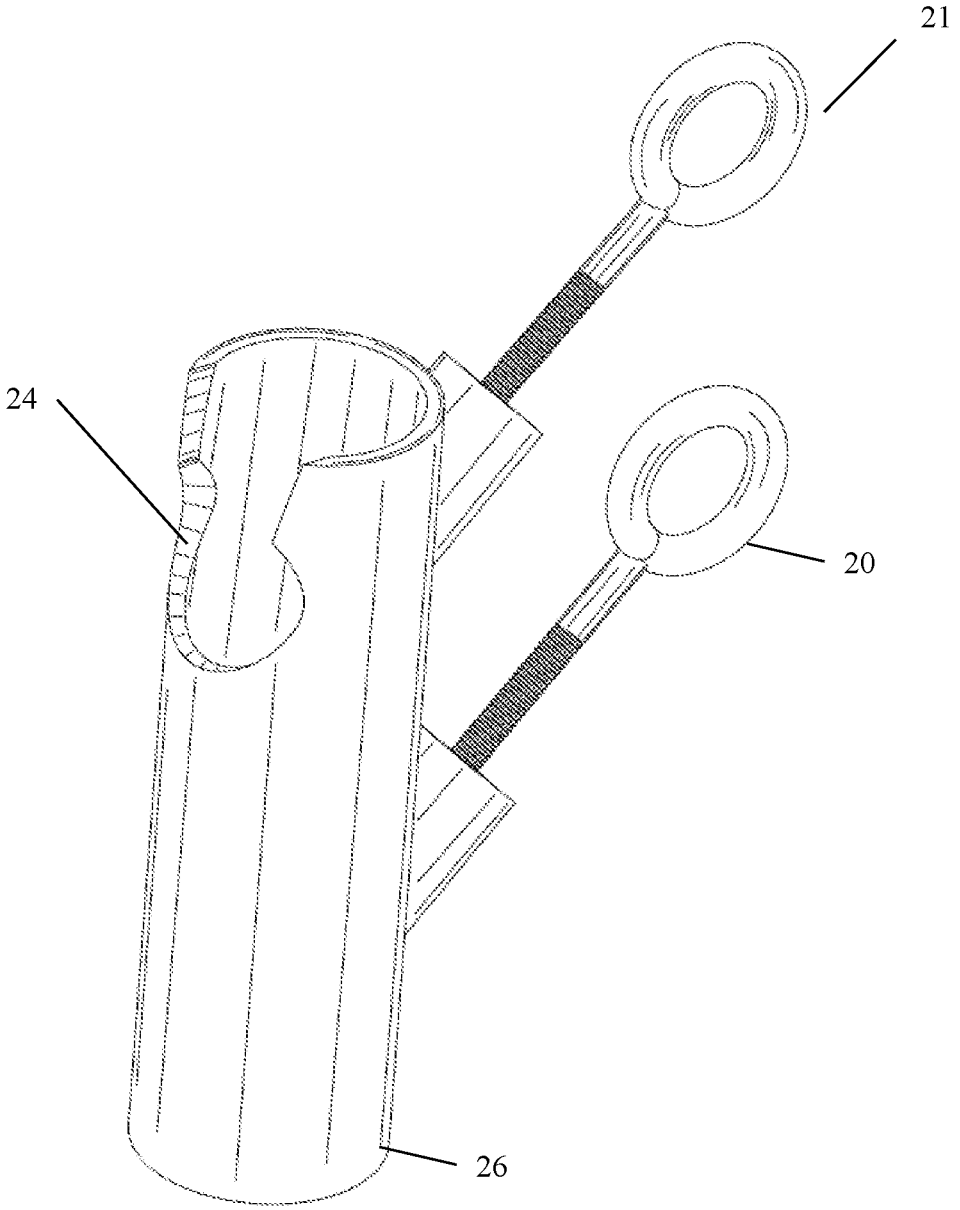
FIG. 14 is the Front Perspective view of the Electrical connector.
Figure 15:
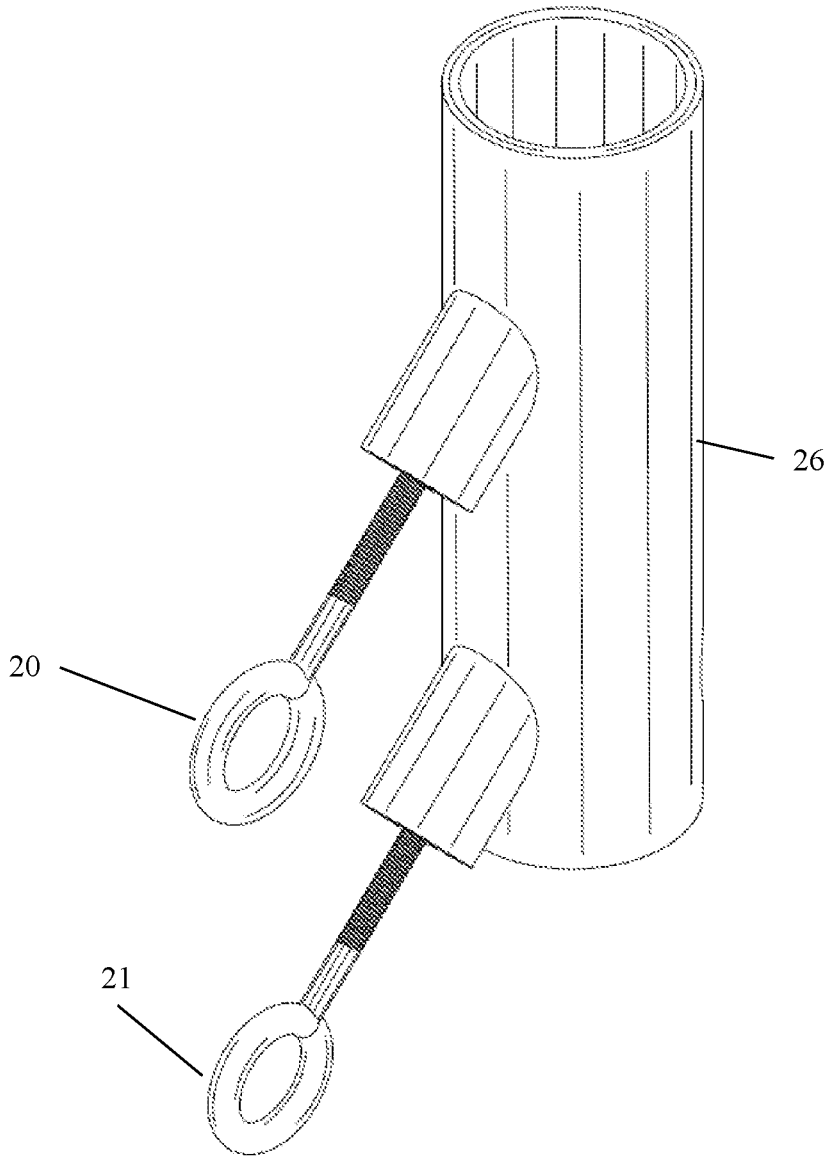
FIG. 15 is the Rear Perspective view of the Electrical connector.
Figure 16:
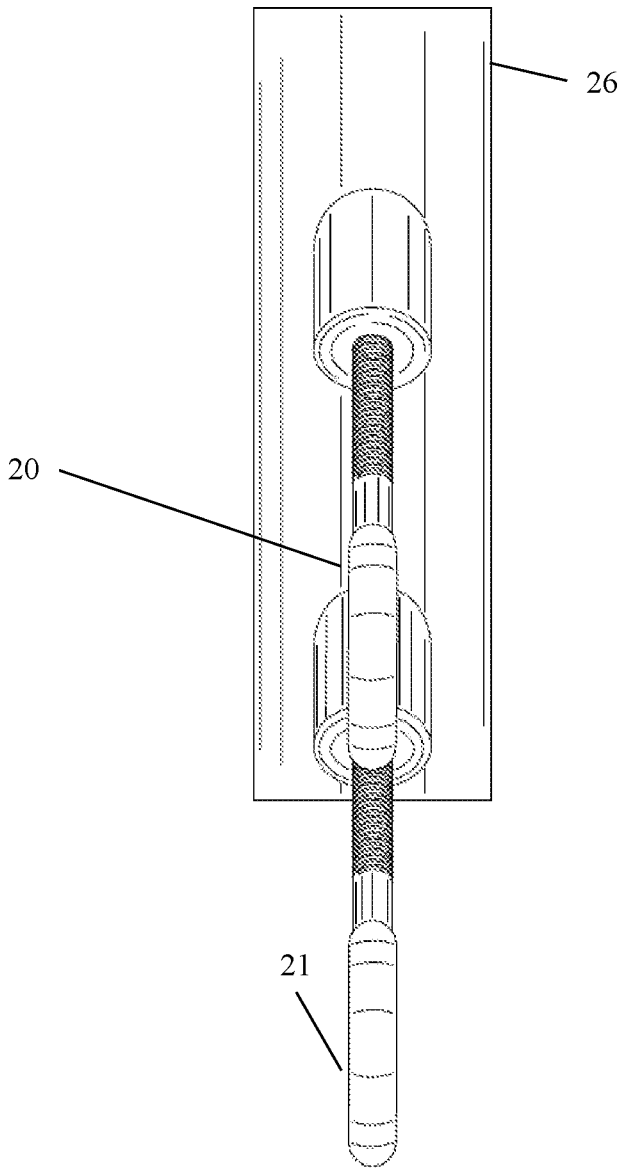
FIG. 16 is the Front view of the Electrical connector of FIG. 1.
Figure 17:
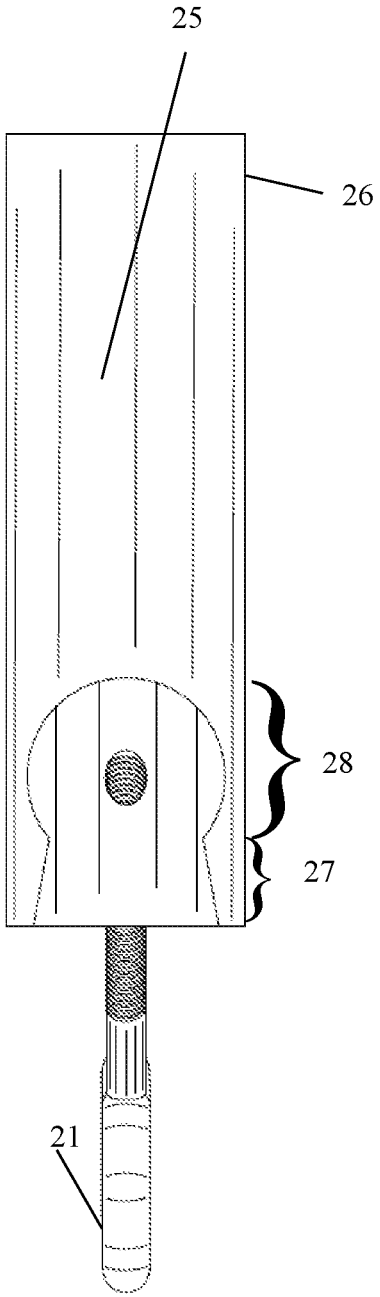
FIG. 17 is the Rear view of the Electrical connector of FIG. 1.
Figure 18:
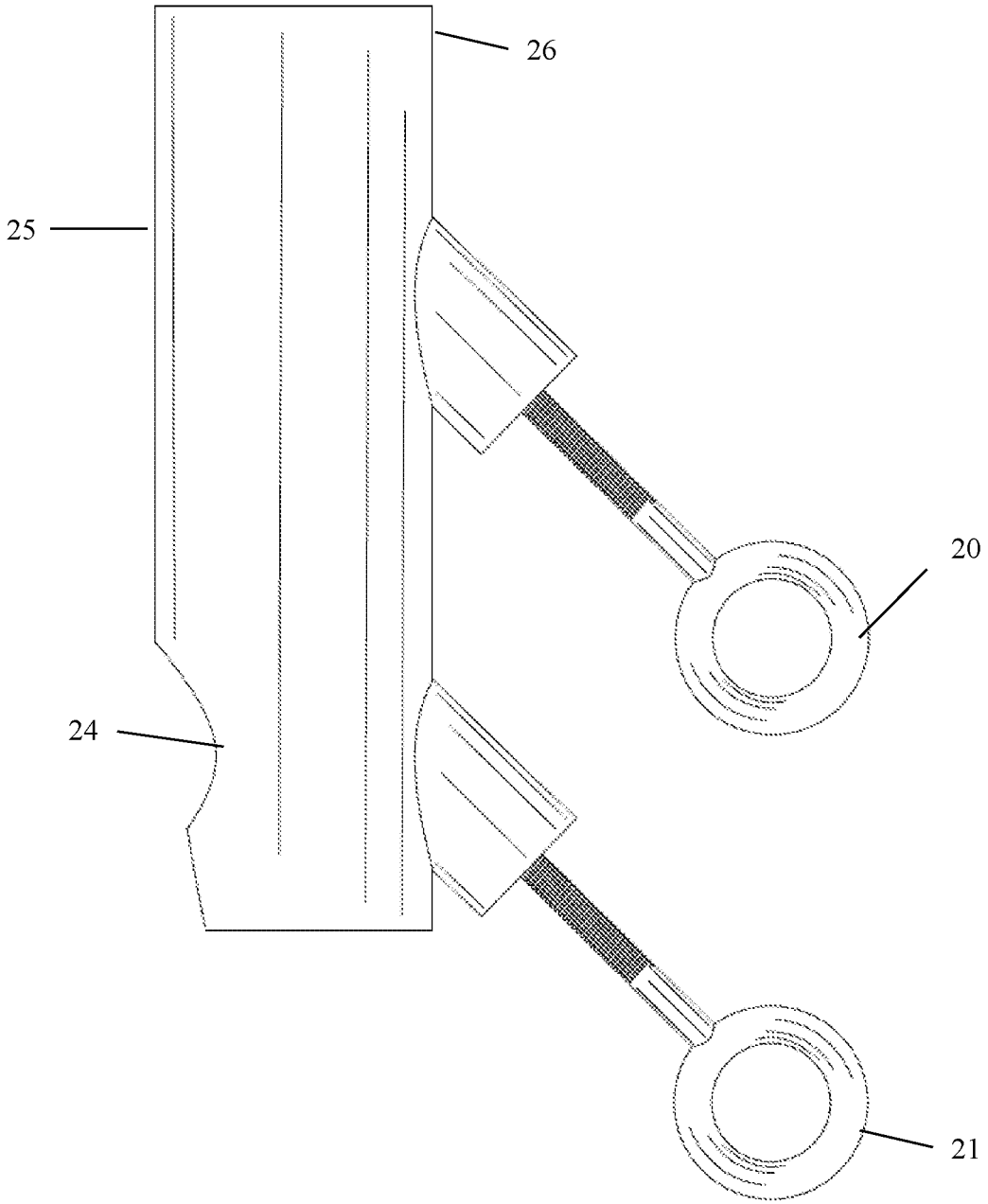
FIG. 18 is the Left side view of the Electrical connector of FIG. 1.
Figure 19:
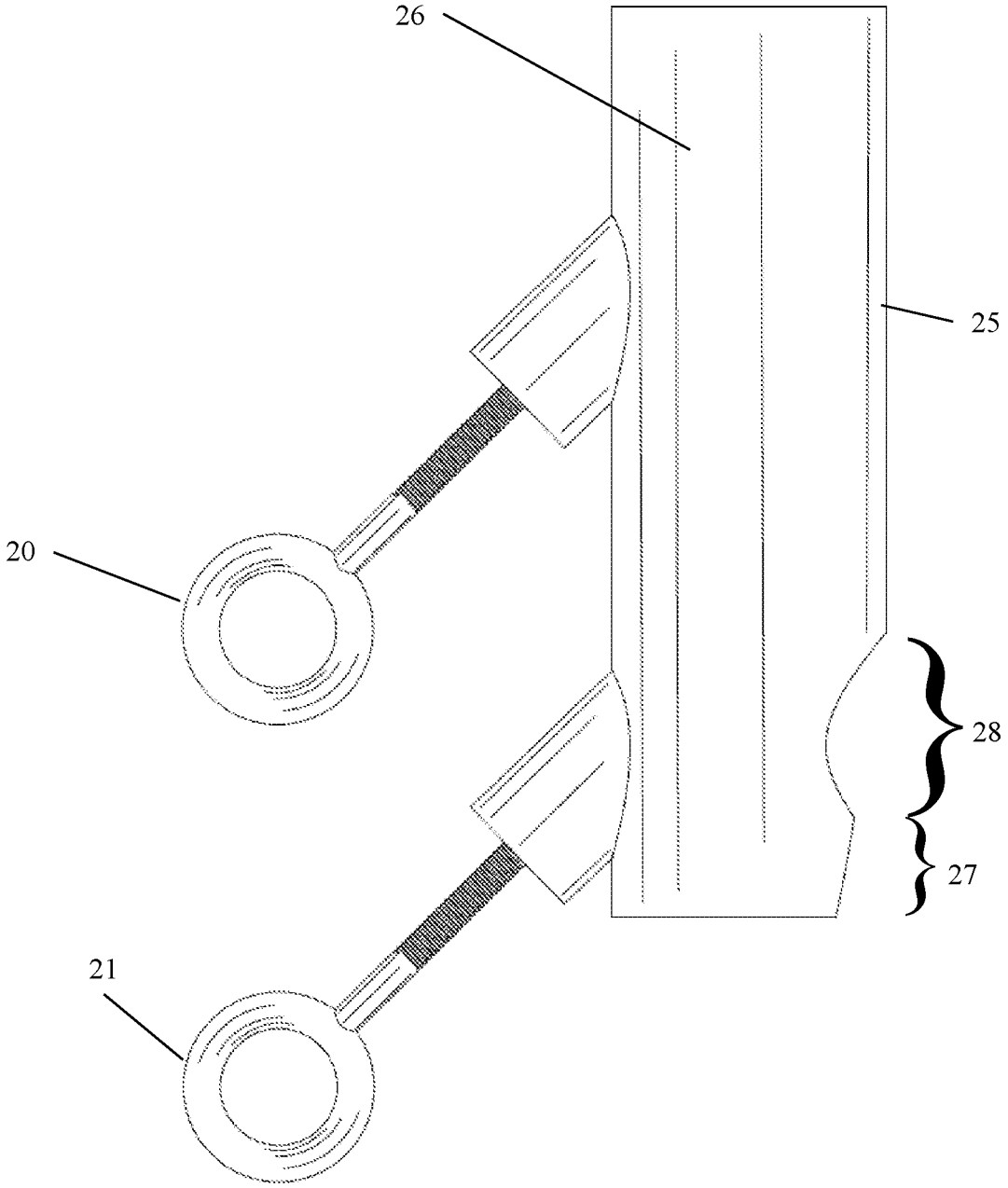
FIG. 19 is the Right side view of the Electrical connector of FIG. 1.
Figure 20:
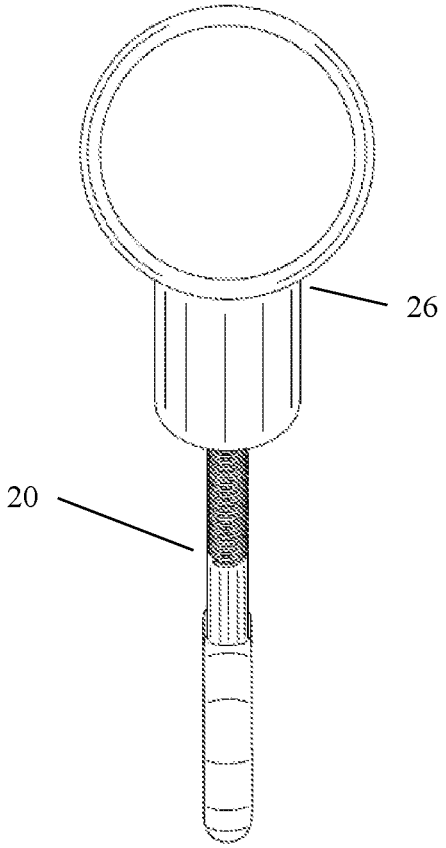
FIG. 20 is the Top view of the Electrical connector of FIG. 1.
Figure 21:
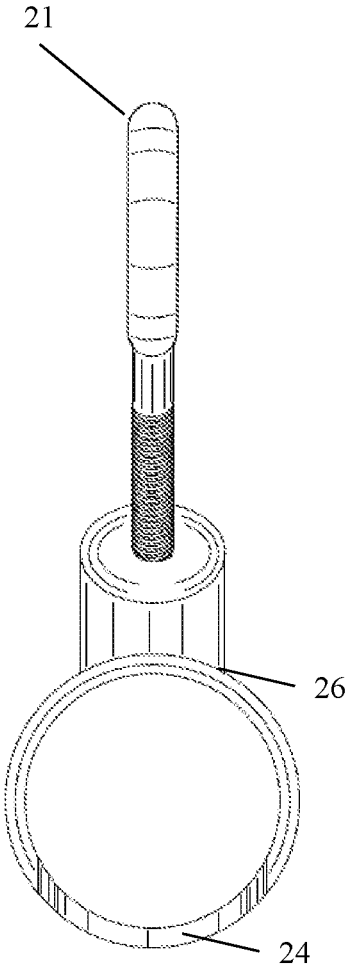
FIG. 21 is the Bottom view side of the Electrical connector of FIG. 1.

FIGS. 11, 12, and 13 are images of the insulated external parking bushing 1 of the present invention, which also include and illustrate a potential cut out 23 for easier coupling or attachment to standard loadbreak elbow known in the prior art and industry.

Now referring to FIGS. 14-21, and improved embodiment of the present invention is taught. The new embodiment replaces the cutout 23, with a very specific "keyhole" shaped cutout 24 design on the bottom 25 of the unit 26. The narrow portion 27 of the "keyhole" shaped cutout 24 is slightly smaller then the neck of the elbow connector that is landing on it. With light force (about the same as required on a standard standoff) the flexible material of the elbow squeezes through the narrow opening of the keyhole shaped cutout 24 and re-expands in the larger portion 28 of the keyhole shaped cutout 24 which is approximately the same size as the neck of the elbow connector that is landing on it, and able to hold the connection firmly enough that the elbow connector can then be released and secured with the threaded eyelet 21.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. An insulated external parking bushing for a 200 amp system, comprising a body member;

the body of the insulated parking bushing is further comprised of a cut out for easier coupling or attachment to a loadbreak elbow;

a contact head extending from the body member for receiving an end of a conductor probe;

a receptor sleeve extending from the body member opposite the contact head;

a conductive sleeve, including a connector cup, for receiving an end of a power cable;

an external parking bushing attached to the body and the receptor sleeve; and the insulated external parking bushing removeably secured to an existing external parking bushing and receptor sleeve and body, covering the contact head and the conductor probe of a 200 amp system.

2. The insulated external parking bushing of claim 1, wherein the cut out of the body of the insulated parking bushing is a very specific keyhole shape.

3. The insulated external parking bushing of claim 2, wherein the keyhold shaped cut out of the body is further comprised of two parts, a narrow portion of the keyhole shaped cutout which is slightly smaller then the neck of the elbow connector that is landing on it; and a larger portion the keyhole shaped cutout which is approximately the same size as the neck of the elbow connector that is landing on it.

4. The insulated external parking bushing of claim 3, wherein with force, the flexible material of the elbow squeezes through the narrow opening of the keyhole shaped cutout and re-expands in the larger portion of the keyhole shaped cutout; and the body is able to hold the connection firmly enough that the elbow connector can then be released and secured with the threaded eyelet.

5. The insulated external parking bushing of claim 1, wherein the body of the insulated external parking bushing is made from a one piece injection mold.

6. The insulated external parking bushing of claim 1, wherein the body of the insulated external parking bushing in constructed from dielectrically rated plastics or rubber.

7. The insulated external parking bushing of claim 1, wherein the body of the insulated parking bushing is identically molded to match the parking bracket.

8. The insulated external parking bushing of claim 7, wherein the body of the insulated parking bushing is molded to adding skirts for higher voltages.

9. The insulated external parking bushing of claim 1, comprised in combination with an electrical load break elbow connector having a conductive probe for making an electrical connection between a high voltage cable and a bushing on electrical power distribution equipment.

* * * * *